US007833056B1

(12) United States Patent
Lee et al.

(10) Patent No.: US 7,833,056 B1
(45) Date of Patent: Nov. 16, 2010

(54) USB APPLICATION DEVICE

(75) Inventors: Tsung-shih Lee, Tu-Cheng (TW); Chia-fa Cheng, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/461,181

(22) Filed: Aug. 4, 2009

(51) Int. Cl.
*H01R 13/648* (2006.01)

(52) U.S. Cl. ..... 439/607.23; 439/946

(58) Field of Classification Search ..... 439/607.23, 439/76.1, 946; 174/737
See application file for complete search history.

(56) References Cited

U.S. PATENT DOCUMENTS 6,676,419 B1 * 1/2004 Lin et al. ..... 439/76.1
6,948,983 B1 * 9/2005 Peng ..... 439/660
6,994,568 B2 * 2/2006 Huang et al. ..... 439/76.1
7,037,120 B1 * 5/2006 Yeh ..... 439/131
7,172,460 B2 * 2/2007 Zhao et al. ..... 439/607.56
7,334,731 B1 * 2/2008 McLean ..... 235/443
7,407,390 B1 * 8/2008 Ni ..... 439/76.1
7,524,198 B2 * 4/2009 Nguyen et al. ..... 439/131

* cited by examiner

*Primary Examiner*—T C Patel
*Assistant Examiner*—Harshad C Patel
(74) *Attorney, Agent, or Firm*—Cheng-Ju Chiang

(57) ABSTRACT

An USB application device includes a housing having a received room therein and a front opening connected to the received room, a PCB having opposite a rear end portion completely received in the receiving room and a front end portion completely extended outside the housing from the front opening and opposite a top surface and a bottom surface, contacts disposed on the top surface of the front end portion of the PCB and exposed outside of the housing, a shell engaged with the housing and completely covers the front end portion of the PCB and the contacts, and a protection element received in the shell and covering the bottom surface of the front end portion of the PCB. The contacts are exposed outside the protection element. The shell is made of metal material for improving ESD protection in order to comply with the USB standard specification.

20 Claims, 5 Drawing Sheets

USB APPLICATION DEVICE

BACKGROUND OF THE INVENTION

1. Field of the Invention

The present invention relates to an USB application device, more specifically, to a miniaturized USB application device.

2. The Related Art

Because Universal serial bus (USB) interface has advantages of high convenience, high compatibility and high transmission speed, it is widely applied to various electronic devices such as personal computers, MP3 players, MP4 players, external storage devices, laptops, flash storage devices, etc. Hence, USB interface becomes one of the standard interfaces of the electronic devices.

A conventional USB compatible application apparatus is disclosed in U.S. Pat. No. 7,165,998. The USB compatible application apparatus has a printed circuit board (PCB) to be a carrying board inside of a connector. A top surface of the PCB carrying board includes a plurality of terminals. A board bottom sandwich is formed between a bottom surface of the PCB carrying board inside the connector and a covering shell of the connector. At least one electrical element is fixed on the bottom surface of the PCB carrying board inside the connector.

Therefore, the present invention can shorten the length of the USB compatible application devices or improve the working efficiency of the USB compatible application device.

Furthermore, the board bottom sandwich has at least one supporting structure, front end protection layer, and a combination thereof capable of connecting to the PCB carrying board. Hence, the supporting structure can fix the size of the board bottom sandwich and prevent the board bottom sandwich from transforming by the unexpected outer force. The front end protection layer can protect the electrical element located inside the board bottom sandwich and meanwhile efficiently strengthen the structure of the board bottom sandwich.

However, the covering shell is selectively made of a non-metal material, e.g. plastic, plasticity steel, or polymer. The strength of the non-metal material covering shell is weaker than metal shell. Therefore, the board bottom sandwich is arranged at the bottom of the supporting structure and the front end protection layer for improving structure.

Moreover, the non-metal material covering shell can not comply with the electrostatic discharge (ESD) testing standard specification. Therefore, the USB compatible application apparatus can not comply with the USB standard specification. Because the electrical element is located on the bottom surface of the PCB carry board, the location of the supporting structure inside the board bottom sandwich must avoid the location of the electrical element. However, it is complex to design the location of the electrical element and the supporting structure at the same layer.

SUMMARY OF THE INVENTION

An object of the present invention is to provide an USB application device has a compact size.

According to the invention, the USB application device has a housing, a printed circuit board, a plurality of contacts, a shell and a protection element. The housing includes a top wall, a bottom wall opposite to the top wall, opposite side walls connected to side edges of the bottom wall and the top wall respectively, a front opening formed between the front edge portions of the bottom wall, the top wall and the side walls, and a receiving room surrounded by the top wall, the bottom wall and the side walls and connected to the front opening.

The printed circuit board includes a top surface, a bottom surface opposite to the top surface, a front end portion and a rear end portion opposite to the front end portion. The rear end portion of the printed circuit board is completely received in the receiving room of the housing. The front end portion of the printed circuit board is completely extended to the outside of the housing from the front opening. The contacts are disposed on the top surface of the front end portion of the printed circuit board and exposed outside of the housing.

The shell engages with the housing and completely covers the front end portion of the printed circuit board and the contacts. The protection element is received in the shell and covers the bottom surface of the front end portion of the printed circuit board. The contacts are exposed outside the protection element.

The shell made of a metal material improves both ESD protection and the strength of the structure. According to the present invention, the USB application can comply with the USB standard specification.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
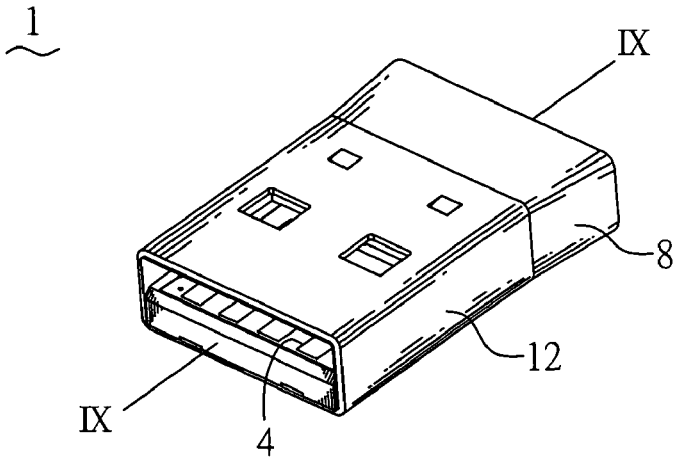
FIG. 1 shows a perspective view of a preferred embodiment of an USB application device according to the present invention.
Figure 2:
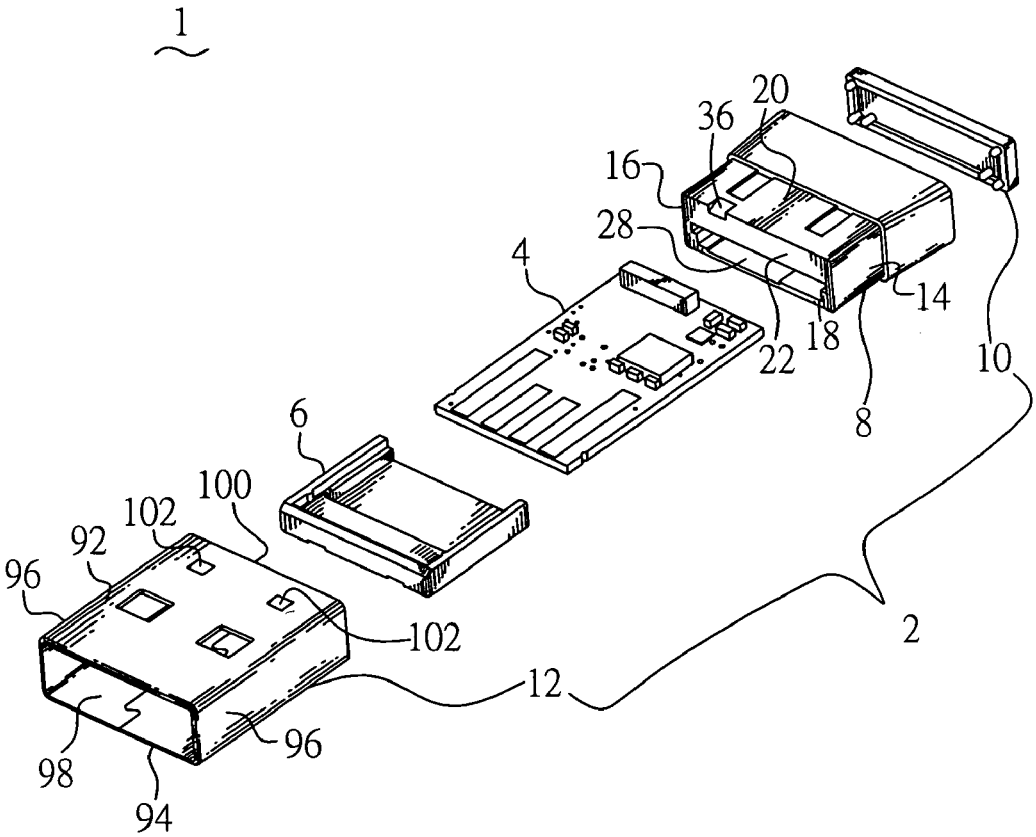
FIG. 2 shows an exploded view of the USB application device according to the present invention.
Figure 3:
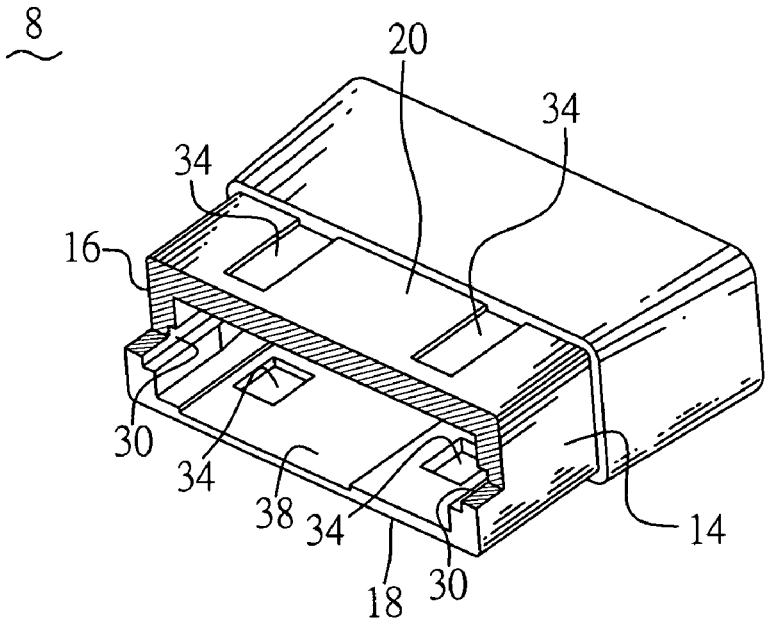
FIG. 3 shows a perspective view of a housing of the USB application being cut a fixing wall and a front portion of a top wall.

Please refer to FIG. 1 and FIG. 2. A preferred embodiment of an USB application device 1 is a wireless USB dongle. The wireless USB dongle can be one of the following standard specifications of Bluetooth, radio-frequency identification (RFID), WiFi, worldwide interoperability for microwave access (WiMAX), ZigBee, global system for mobile communications (GSM), General packet radio service (GPRS), 3rd generation partnership project (3GPP), global positioning system (GPS), etc.

The USB application device 1 has a casing 2, a PCB 4 and a protection element 6. The PCB 4 and the protection element 6 are received in the casing 2. The casing has a housing 8, a rear cover 10 and a shell 12. The housing 8, the rear cover 10 and the protection element 6 are made of an isolated material. The shell 12 is made of a metal material.

Please refer to FIG. 2, FIG. 3, FIG. 4 and FIG. 10. The housing 2 has a first side wall 14, a second side wall 16 opposite to the first side wall 14, a bottom wall 18, a top wall 20 opposite to the bottom wall 18, and a fixing wall 22. The first side wall 14 and the second side wall 16 connect to opposite side edges of the bottom wall 18 and the top wall 20 respectively.

The fixing wall 22 extends from an inner surface of the top wall 20. Especially, the fixing wall 22 perpendicularly extends from a front edge of the top wall 20 and towards the bottom wall 18. The opposite edges of the fixing wall 22 connect to the first side wall 14 and the second side wall 16 respectively. An outer surface of the fixing wall 22 and the front edges of the first side wall 14, the second side wall 16, the bottom wall 18 and the top wall 20 are at the same level.

The first side wall 14, the second side wall 16, the bottom wall 18 and the top wall 20 form a receiving room 24. The rear edges of the first side wall 14, the second side wall 16, the bottom wall 18 and the top wall 20 form a rear opening 26. The front edges of the first side wall 14, the second side wall 16, the bottom wall 18, and a bottom edge of the fixing wall 22 form a front opening 28.

Each of inner surfaces of the first side wall 14 and the second side wall 16 form a channel 30. Each of corners where the rear edge of the bottom wall 18 connects to the rear edges of the first side wall 14 and the second side wall 16, and each of corners where the rear edge of the top wall 20 connects to the rear edges of the first side wall 14 and the second side wall 16, form holes 32 respectively.

Each of outer surfaces of the bottom wall 18 and the top wall 20 is formed at least two hollows 34. A first guiding portion 36 is formed at an outer surface of a corner where the top wall 20 connects to the fixing wall 22 and aligned with one of the hollows 34 formed on the top wall 20. An inner surface of the bottom wall 18 is formed a concave portion 38. Especially, the first guiding portion 36 is a slanted surface.

Figure 5:
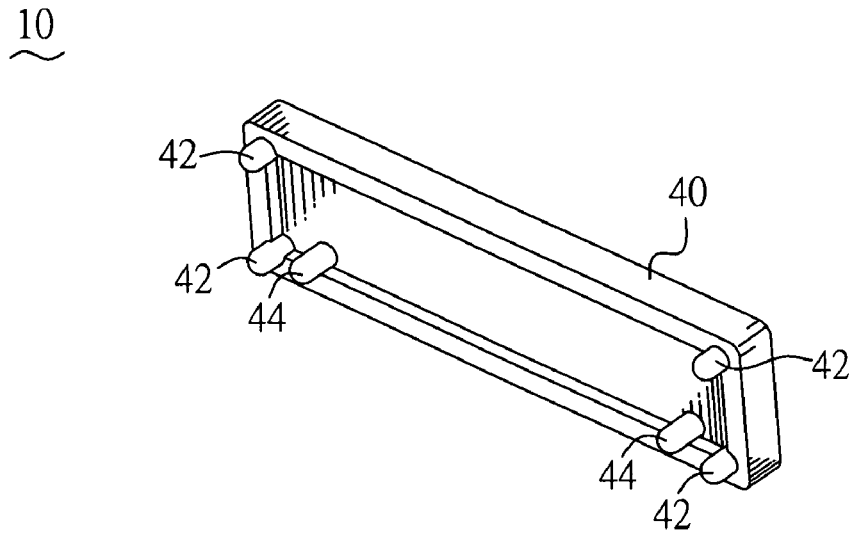
FIG. 5 is a perspective view of a rear cover according to the present invention.

Please refer to FIG. 5. The rear cover 10 has a body portion 40, a plurality of pillars 42 and a first supporting portion 44. The body portion 40 is of a plate. The profile of the body portion 40 matches up the profile of the rear opening 26 of the housing 8. In this case, the housing 8 and the rear opening 26 are substantially of a rectangular shape, and therefore, the body portion 40 of the rear cover 10 is also of a rectangular shape.

The pillars 42 are aligned with the holes 32 of the housing 8 respectively. Hence, the pillars 42 are protruded from one surface of four corners of the body portion 40 respectively and are perpendicular to the body portion 40. The supporting portion 44 is protruded from the surface of the body portion 40. Especially, the supporting portion 44 is of a pillar.

Figure 4:
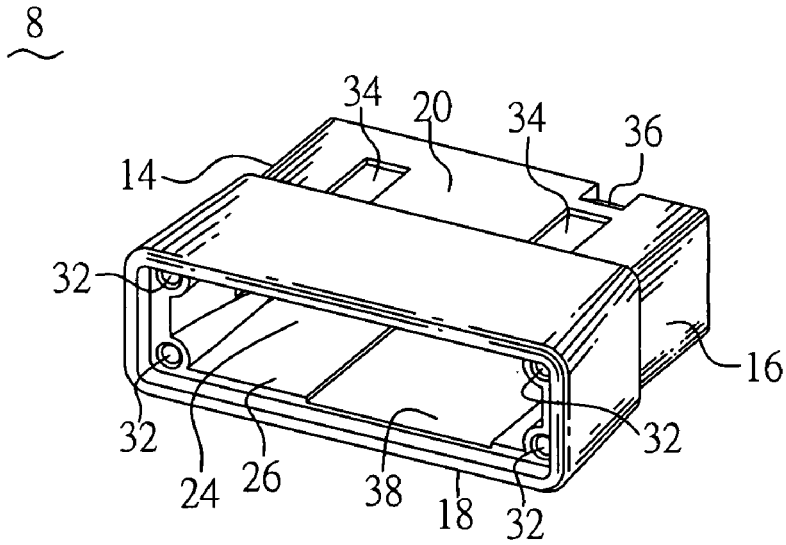
FIG. 4 is a rear view of the housing according to the present invention.
Figure 6:
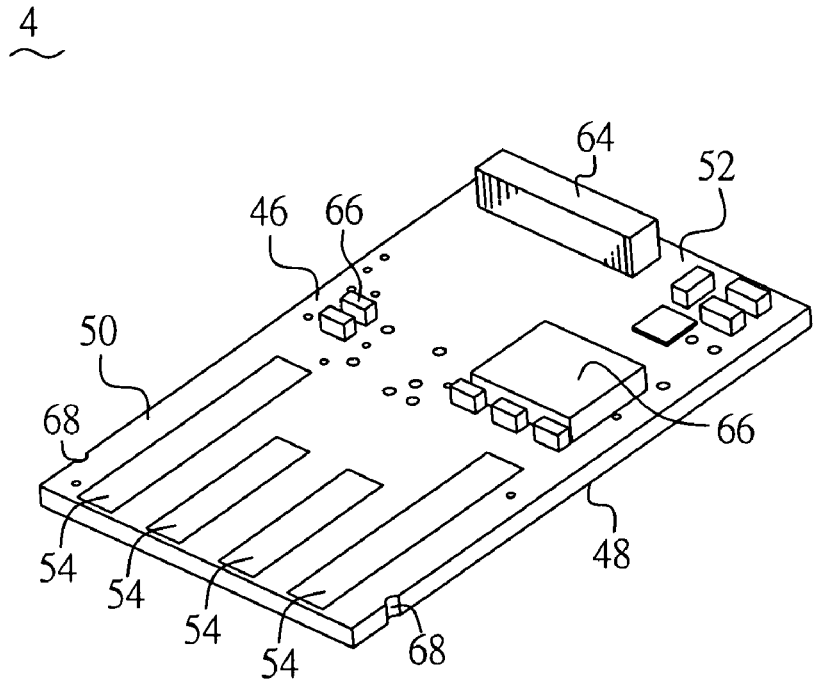
FIG. 6 shows a printed circuit board according to the present invention.

Please refer to FIG. 4 and FIG. 6. The PCB 4 has a top surface 46, a bottom surface 48 opposite, to the top surface 46, a front end portion 50 and a rear end portion 52 opposite to the front end portion 50. The top surface 46 of the front end portion 50 is disposed four contacts 54. The contacts 54 functions as power contact (VCC), ground contact (GND) and differential signal transmission contacts (D+, D−) to comply with the USB standard specification. An integrated circuit (IC) 56 is located on the bottom surface 48 of the PCB 4 and between the front end portion 50 and the rear end portion 52.

Figure 7:
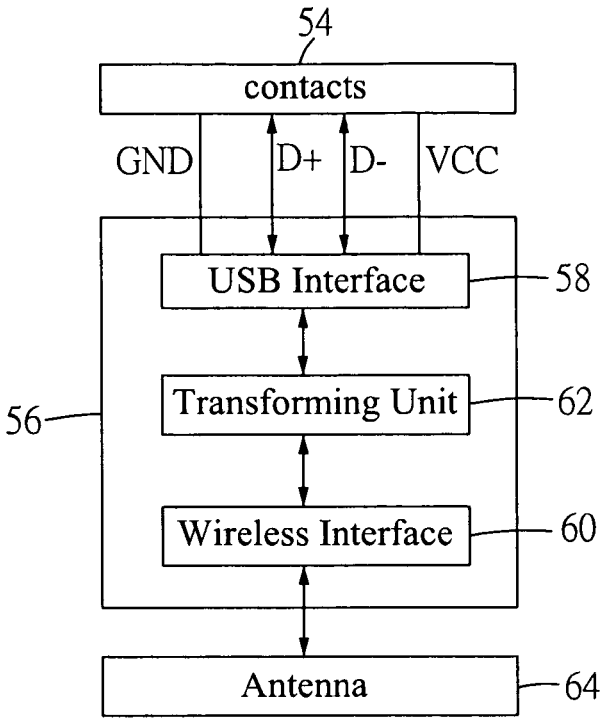
FIG. 7 shows a block diagram of a integrated circuit according to the present invention.

Please refer to FIG. 7. The IC 56 has an USB interface 58, a wireless interface 60 and a transforming unit 62 interconnecting the USB interface 58 and the wireless interface 62. In this case, the wireless interface 60 is a Bluetooth interface. The transforming unit 62 can receive USB signal form the USB interface 58 and transforming USB signal to Bluetooth signal, and than send Bluetooth signal to the wireless interface 60.

The transforming unit 62 also can receive Bluetooth signal form the wireless interface 60 and transforming Bluetooth signal to USB signal, and than send USB signal to the USB interface 58. Hence, the transforming unit 62 functions as a bridge between the USB interface 58 and the wireless interface 60. Moreover, the wireless interface 60 can be one of RFID, WiFi, WiMAX, ZigBee, GSM, GPRS, 3GPP, GPS.

The USB interface 58 of the IC 56 connects the contacts 54 via a set of conducting traces (not shown in figures) printed on the PCB 4. The top surface 46 of the rear end portion 52 is disposed an antenna 64 connecting to the wireless interface 60 of the IC 56 via another conducting trace (not shown in figures). The antenna 64 can transmit and receive wireless Bluetooth signal.

The top surface 46, and the bottom surface 48 of the front end portion 50 are disposed a plurality of electrical elements 66. A peripheral portion of the antenna 64 at the top surface 46 and the bottom surface 48 of the PCB 4 is not disposed any electrical element 66 for preventing the antenna 64 from interference. Each of the side edges of the front end portion 50 of the PCB 4 is formed as an indentation 68.

Figure 8:
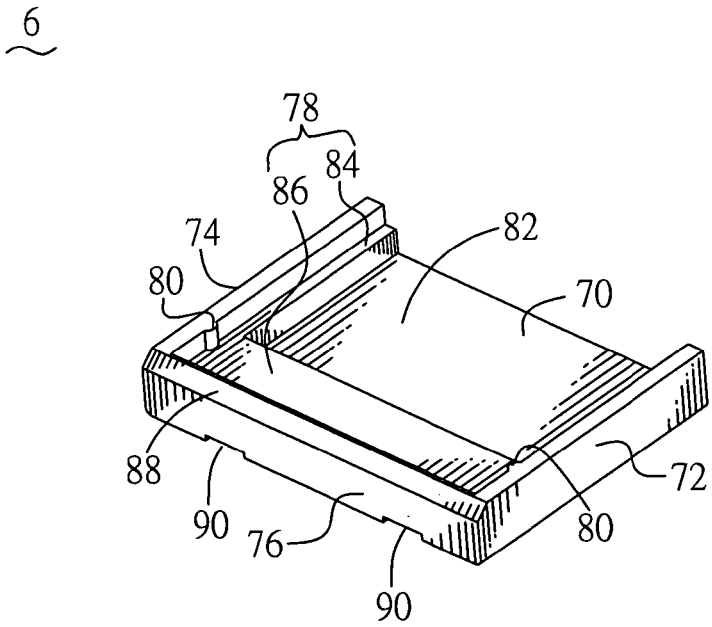
FIG. 8 is a perspective view of a protection element according to the present invention.
Figure 9:
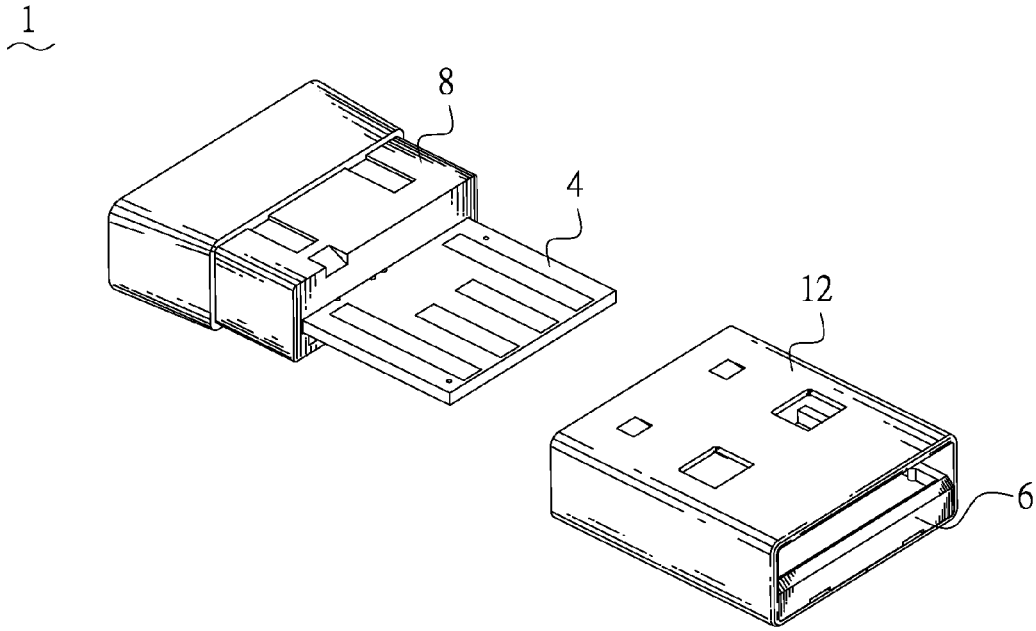
FIG. 9 is a perspective view showing the printed circuit board assembled to the housing, and the protection element assembled to the shell according to the present invention.
Figure 10:
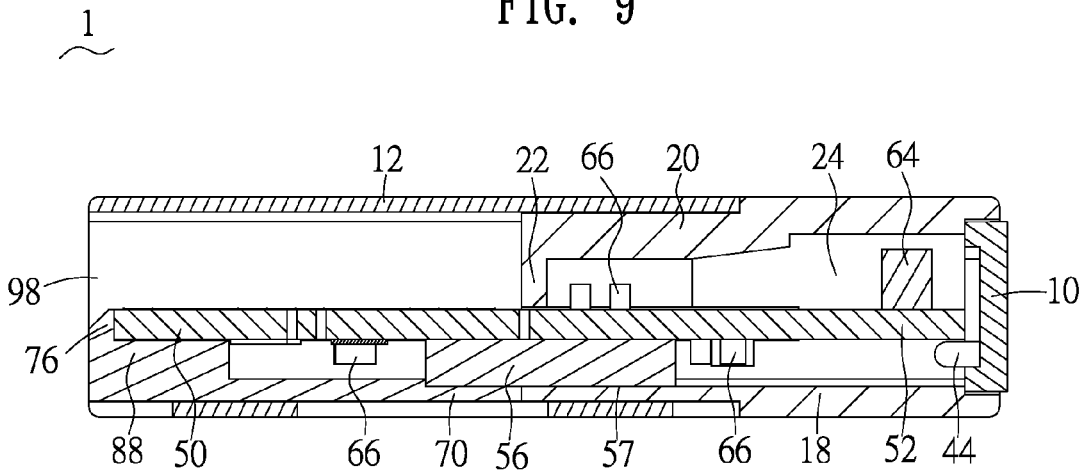
FIG. 10 is a cross-sectional view of the USB application device taken along line X-X in FIG. 1.

Please refer to FIG. 8. the protection element 6 has a bottom board 70, a first side board 72, a second side board 74, a front board 76, a second supporting portion 78 and projections 80. The first side board 72 and the second side board 74 perpendicularly extend from the opposite side edges of the bottom board 70 respectively. The front board 76 perpendicularly extends from a front edge of the bottom board 70 and connects the first side board 72 and the second side board 74.

The bottom board 70, the first side board 72, the second side board 74 and the front board 76 form a receiving space 82. The second supporting portion 78 is arranged in the receiving space 82. The second supporting portion 78 has a base 84 and ribs 86. The base 84 is formed at a corner where an'inner surface of the bottom board 70 connects to an inner surface of the front board 76. Each of the ribs 86 is formed at corners where the inner surface of the bottom board 70 connects to the inner surfaces of the first side board 72 and the second side board 74.

A top surface of the base 86 and top surfaces of the ribs 84 are at the same level. The projections 80 protrude from the inner surfaces of the first side board 72 and the second side board 74 respectively. A top surface of the front board 76 is formed a second guiding portion 88. Especially, the second guiding portion 88 is a slanted surface. At least two grooves 90 straight formed on the outer surface of the bottom board 70. The grooves 90 opens at a front edge of the bottom board 70 and are align with the hollows 34 formed on the outer surface of the bottom wall 18 of the housing 8.

Please refer to FIG. 2 again. The shell 12 has a top plate 92, a bottom plate 94 opposite to the top plate 92 and opposite side plates 96. The side plates 96 connect opposite edges of the top plate 92 and the bottom plate 94 respectively. Hence, the shell 12 is of a sleeve-shape and formed a front mouth 98 and a rear mouth 100. The top plate 92 and the bottom plate 94 are formed two wedges 102 respectively (only shown the wedges at the top plate).

Please refer to FIG. 1, FIG. 2, FIG. 9 and FIG. 10. The fabricating method of the USB application device 1 are described as following. The PCB 4 is inserted in to the housing 8 either from the rear opening 26 or from the front opening 28 of the housing 8 and meanwhile the side edges of the PCB 4 are slid and received in the channels 30. The channels 30 can fix the PCB and prevent the PCB 4 from shifting along a first direction defined from the bottom wall 18 to the top wall 20.

The rear end portion 52 of the PCB is completely received in the receiving room 24 of the housing 8. The front end portion 50 of the PCB 4 stretches out the housing 8 from the front opening 28 of the housing 8 and the contacts 54 are exposed outside the housing 8. The rear cover 10 covers the rear opening 26 of the housing 8. The first supporting portion 44 of the rear cover 10 connects the bottom surface 48 of the rear end portion 52 of the PCB 4 and supports the rear end portion 52 of the PCB 4.

The IC 56 further has a printed surface 57. Generally speaking, the printed surface 57 is printed or carved serial number, manufacturer's name, manufacturer's mark of the IC 56. The IC 56 is partially received in the concave portion 38 formed on the inner surface of the bottom wall 18 of the housing 8. The printed surface 57 of the IC 56 connects the inner surface of the concave portion 38.

Hence, the IC 56 supports the middle portion of the PCB 4 between the front end portion 50 and the rear end portion 52. The bottom edge of the fixing wall 22 connects the top surface 46 of the PCB 4. The middle portion of the PCB 4 and the IC 56 are together sandwiched in the opening 28 of the housing 8 and between the bottom edge of the fixing wall 22 and the inner surface of the bottom wall 18.

The projections 80 of the protection element 6 are engaged into the indentations 68 formed on the side edges of the PCB 4. The second supporting portion 78 connects and supports the front end portion 50 of the bottom surface 48 of the PCB 4. The protection element 6 covers the bottom surface 48 and side edges of the front end portion 50 of the PCB 4.

The contacts 54 and the top surface 46 of the front end portion 50 of the PCB are exposed outside the protection element 6. Hence, The protection element 6 can protect the electrical elements 66 fixed on the bottom surface 48 of the front end portion 50 of the PCB 4 from outer force, and enhance the strength of the PCB for resisting the external force.

The inner surface of the concave portion 38 of the housing 8 and the inner surface of the bottom board 70 of the protection element 6 are at the same level. Hence, the printed surface of the IC 56 can connect the inner surface of concave portion 38 of the housing 8 and the inner surface of the bottom board 70 of the protection element 6.

According to the present invention, the surfaces of the base 86 and the ribs 84 of the second supporting portion 78 of the protection element 6, an upper side of the first supporting portion 44 of the rear cover 10 and the channels 30 of the housing 8 can be kept at the same level while the PCB 4, the housing 8, the rear cover 10 and the protection element 6 are assembled.

The projection 38 of the housing 2 is engaged into the concave 58 of the PCB 4 for preventing the PCB from shift along a second direction defined from the fixing wall 30 to the rear wall 16. The edges of the PCB 4 also abut against the inner surfaces of the first side wall 8 and second side wall 10 of the housing 2 respectively for preventing the PCB from shifting along a third direction defined from the first side wall 8 to the second side wall 10.

The front end portion 50 of the PCB 4 and the protection element 6 are together received into the shell 12 from the rear mouth 100 of the shell 12. The wedges 102 formed on the top plate 92 and the bottom plate 94 are guided by the first guiding portion 36 of the housing 8 and the grooves 90 of the protection element 6, and then engaged into the hollows 34 formed on the top wall 20 and the bottom wall 18 of the housing 8. Therefore, the shell 12 is fixed with the housing 8.

A front surface of the front board 76 of the protection element 6 and the front mouth 98 of the shell 12 are at the same level. The outer surfaces of the bottom board 70, the first side board 72 and the second side board 74 of the protection element 6 are attached and fixed to inner surfaces of the bottom plate 94 and the opposite side plates 96 of the shell 12 respectively.

Therefore, the PCB 4, the protection element 6, housing 8, the rear cover 10 and the shell 12 can be firmly assembled. Furthermore, the protection element 6 can be integrated with the shell 12 as one piece molding and then together assembled with the PCB 4 and the housing 8. Hence, the strength of the USB application device 1 can be improved.

The projections 80 of the protection element 6 and the indentations 68 of the PCB 4 prevent the PCB from shifting along a second direction defined from the front board 76 of the protection element 6 to the body portion 40 of the rear cover 10. The side edges of the PCB 3 abut against the inner surfaces of the first side wall 14 and the second side wall 16 of the housing 8 and the inner surfaces of the first side board 72 and the second side board 74 of the protection element 6 to prevent the PCB 4 from shifting along a third direction defined from first side wall 14 to second side wall 16.

The contacts 54, the front end portion 50 of the PCB 4 and the shell 12 together form as a standard A-type USB connector. The shell 12 can enhance ESD protection and therefore the USB application device 1 can comply with the USB standard specification.

If the USB application device 1 couples to the electrical apparatuses, a carrying housing or a carrying board of a mating connector of the electronic apparatuses (not shown in figures) is guided to slide into a space between the top surface 46 of the PCB 4 and the shell 12 by the second guiding portion 88. Hence, the mating contacts of the mating connector can couple to the contacts 54 of PCB 4 of the USB application device 1.

As described above, because the IC 56 is fixed on the second surface 48 and between the middle of the PCB 4, and the printed surface 57 of the IC 56 contacts the inner surface of the bottom wall 18 of the housing 8, the middle portion of the PCB 4 is supported by the IC 56. Because the IC 56 and the middle portion of the PCB 4 are sandwiched between the front opening 28 and the bottom edge of the fixing wall 22 connects the top surface 46 of the middle portion of the PCB 4 opposite to the IC 56, the PCB 4 can be fixed in the housing 8 and the strength of the PCB 4 resisting the external force can be improved.

The first supporting portion 44 of the rear cover 10 supports the rear end portion 52 of the PCB 4 for improving the strength of the PCB 4 to resist the external force and fixing the PCB 4. The side edges of the PCB 4 is received in the channels 30 of the housing 8, the projection 80 of the protection element 6 is engaged in the indentations 58 of the PCB 4 for preventing the PCB 4 from shifting.

The contacts 54, the front end portion 50 of the PCB 4 and the shell 12 together form as a A-type connector. The shell 12 can not only improve ESD protection of the USB application device 1 to comply with the USB standard specification, but also improve the strength of the USB application device 1.

Furthermore, the present invention is not limited to the embodiments described above; diverse additions, alterations and the like may be made within the scope of the present invention by a person skilled in the art. For example, respective embodiments may be appropriately combined.

What is claimed is:

1. A USB application device, comprising:

a housing comprising a top wall, a bottom wall opposite to the top wall, a plurality of opposite side walls connected to the corresponding side edges of the bottom wall and the top wall respectively, a front opening formed between the front edge portions of the bottom wall, the top wall and the side walls, and a receiving room surrounded by the top wall, the bottom wall and the side walls, the receiving room connected to the front opening;

a printed circuit board comprising a top surface, a bottom surface opposite to the top surface, a front end portion, and a rear end portion opposite to the front end portion;

a plurality of contacts disposed on the top surface of the front end portion of the printed circuit board, the rear end portion of the printed circuit board received in the housing, and the front end portion of the printed circuit board extending outside the housing from the front opening, the contacts exposed to the outside of the housing;

a shell engaged to the housing and completely covering the front end portion of the printed circuit board and the contacts; and a protection element received in the shell and covering the bottom surface of the front end portion of the printed circuit board, the contacts exposed from an upper surface of the protection element.

2. The USB application device as claimed in claim 1, wherein the front edge portion of the top wall of the housing perpendicular extends a fixing wall towards the bottom wall, the front opening is formed between a bottom edge of the fixing wall and the front edge portions of the bottom wall and the side walls.

3. The USB application device as claimed in claim 2, wherein the bottom surface of the printed circuit board has a middle portion to be fixed with an integrated circuit having a printed surface, the middle of the printed circuit board and the integrated circuit are together sandwiched in the front opening, the printed surface of the integrated circuit connects to an inner surface of the bottom wall and the bottom edge of the fixing wall connects to the top surface of the middle portion of the printed circuit board, the housing and the protection element made of an isolated material, the contacts and the shell made of a metal material.

4. The USB application device as claimed in claim 3, wherein the rear edge portions of the top wall, the bottom wall and the side walls form a rear opening opposite to the front opening and connect to the receiving room, the rear opening is covered by a rear cover.

5. The USB application device as claimed in claim 4, the rear cover has a body portion and a first supporting portion extended from one surface of the body portion and into the receiving room through the rear opening of the housing to support the rear end portion of the printed circuit board.

6. The USB application device as claimed in claim 5, wherein at least one of the rear edge portions of the top wall, the bottom wall and the side walls forms at least one hole, the rear cover has at least one pillar extended from the surface of the body portion and engaged into the at least one hole of the housing.

7. The USB application device as claimed in claim 6, wherein the first supporting portion is of a pillar shape and the body portion of the rear cover is of a plate shape.

8. The USB application device as claimed in claim 3, wherein the top surface of the rear end portion of the printed circuit board is fixed with an antenna to connect to the integrated circuit.

9. The USB application device as claimed in claim 8, wherein the integrated circuit has an USB interface connected to the contacts, a wireless interface connected to the antenna and a transforming unit interconnected the USB interface and the wireless interface.

10. The USB application device as claimed in claim 5, wherein side edges of the printed circuit board respectively received in channels respectively formed on inner surfaces of the side walls and being at the same level with an upper surface of the first supporting portion.

11. The USB application device as claimed in claim 10, wherein the protection element has a bottom board, a plurality of opposite side boards extended from opposite side edges of the bottom board, a front board extended from a front edge of the bottom board and connected to the side boards, a receiving space surrounded by the bottom board, the side boards and the front board, and a second supporting portion arranged in the receiving space and supporting the front end portion of the printed circuit board, a top surface of the second supporting portion, the upper surface of the first supporting portion of the rear cover and the channels of the housing being at the same level.

12. The USB application device as claimed in claim 11, wherein the second supporting portion has a base extended from an inner surface of a corner portion between the bottom board and the front board and ribs extended from inner surfaces of corner portions between the bottom board and the side boards respectively.

13. The USB application device as claimed in claim 11, wherein an inner surface of the bottom wall of the housing forms a concave portion, the printed surface of the integrated circuit connects an inner bottom surface of the concave portion of the housing and an inner surface of the bottom board of the protection element.

14. The USB application device as claimed in claim 11, wherein each of side edges of the front end portion of the printed circuit board forms an indentation, each of inner surfaces of the side boards of the protection element extends a projection engaged into the indentation.

15. The USB application device as claimed in claim 11, wherein a top surface of the front board of the protection element defines a guiding portion.

16. The USB application device as claimed in claim 15, wherein the guiding portion is a slanted surface.

17. The USB application device as claimed in claim 1, wherein each of outer surfaces of the top wall and the bottom wall forms a hollow, each of a top plate and a bottom plate of the shell protrudes a wedge engaged into the hollow.

18. The USB application device as claimed in claim 1, wherein the contacts, the front end portion of the printed circuit board and the shell form as an USB connector.

19. A USB application device, comprising:

an isolated housing comprising a top wall, a bottom wall opposite to the top wall, opposite side walls connected to side edges of the bottom wall and the top wall respectively, a front opening formed between front edge portions of the bottom wall, the top wall and the side walls, and a receiving room surrounded by the top wall, the bottom wall and the side walls and connected to the front opening;

a printed circuit board comprising a top surface, a bottom surface opposite to the top surface, a front end portion and a rear end portion opposite to the front end portion, and inserted into the housing from the front opening, the rear end portion completely received in the receiving room of the housing, the front end portion completely positioned outside the housing, the top surface faced to the top wall, the bottom surface faced to the bottom wall;

a plurality of metal contacts disposed on the top surface of the front end portion of the printed circuit board and exposed outside the housing;

a metal shell engaged to the housing and completely covering the front end portion of the printed circuit board and the contacts; and an isolated protection element received in the shell, covering the bottom surface of the front end portion of the printed circuit board, and engaged with at least one of the printed circuit board and the shell, the contacts exposed from an upper surface of the protection element.

20. A USB application device, comprising:

an isolated sleeve comprising a top wall, a bottom wall opposite to the top wall, opposite side walls connected to side edges of the bottom wall and the top wall respectively, a front opening and a rear opening opposite to the front opening;

a printed circuit board comprising a top surface, a bottom surface opposite to the top surface, a front end portion and a rear end portion opposite to the front end portion, and inserted into the housing from either the front opening or the rear opening, the rear end portion completely received in receiving room of the housing, the front end portion completely extended outside the housing near the front opening, the top surface faced to the top wall, the bottom surface faced to the bottom wall;

a plurality of metal contacts disposed on the top surface of the front end portion of the printed circuit board and exposed outside the housing;

a metal shell engaged to the housing and completely covering the front end portion of the printed circuit board and the contacts;

an isolated protection element received in the shell, covering the bottom surface of the front end portion of the printed circuit board, and engaged with at least one of the printed circuit board and the shell, the contacts exposed from an upper surface of the protection element; and a rear cover engaged with the housing and covering the rear opening of the housing.

* * * * *